United States Patent [19]

Letarte et al.

[11] Patent Number: 4,979,884

[45] Date of Patent: Dec. 25, 1990

[54] MULTI-CYLINDER PUMP FOR HEAVY FLOWABLE MATERIALS

[75] Inventors: René Letarte, Cap-Rouge; Lionel Letarte, St-Nicolas; Gilles Savard, St-Jean Chrysostome, all of Canada

[73] Assignee: La Cie de Machinerie Rennel Inc., St. Romuald, Canada

[21] Appl. No.: 475,792

[22] Filed: Feb. 6, 1990

[30] Foreign Application Priority Data

Jan. 17, 1990 [CA] Canada ..... 2007977

[51] Int. Cl.[5] ..... F04B 15/00

[52] U.S. Cl. ..... 417/532; 137/874; 251/175

[58] Field of Search ..... 251/175, 187, 188; 137/874; 417/519, 531, 532, DIG. 1, 900

[56] References Cited

U.S. PATENT DOCUMENTS

| | | | |
|---|---|---|---|
| 4,133,418 | 1/1979 | Van Bilderbeck | 137/874 X |
| 4,198,193 | 4/1980 | Westerland | 417/532 X |
| 4,613,290 | 9/1986 | Everson | 417/532 X |
| 4,614,483 | 9/1986 | Hudelmaier | 417/532 X |
| 4,653,990 | 3/1987 | Schlecht | 417/532 X |

*Primary Examiner*—John C. Fox

*Attorney, Agent, or Firm*—Oblon, Spivak, McClelland, Maier & Neustadt

[57] ABSTRACT

A two-cylinder pump for heavy flowable material comprising a pump body with a deck surface, a pair of cylinder bores opening at the deck surface, and a piston reciprocating in each cylinder bore in charging and discharging strokes. The pump further includes a valve conduit with an inlet port for the transfer of flowable material between the valve conduit and the cylinder bores, the valve conduit being pivotable about an axis to cause a movement of the inlet port across the deck surface between two operative positions, in each operative position the inlet port being in register with either one of the cylinder bores. A fluid operated piston-cylinder assembly is operatively mounted between the valve conduit and the pump body in order to produce a force with a direction generally coincident with the pivotal axis on the valve conduit for urging the inlet port thereof in sealing engagement with the deck surface of the pump body.

14 Claims, 5 Drawing Sheets

MULTI-CYLINDER PUMP FOR HEAVY FLOWABLE MATERIALS

FIELD OF THE INVENTION

The invention relates to the general field of fluid transfer and more particularly to a pump for heavy flowable materials, such as sludge, slurry or concrete, of the multi-cylinder type with an oscillating valve conduit, having good sealing characteristics between the valve conduit and the pump body.

BACKGROUND OF THE INVENTION

Multi-cylinder pumps used for pumping heavy flowable materials such as sludge, slurry or concrete are extremely popular in various fields. Concrete pumps are usually mounted on a suitable vehicle, such as a truck or a trailer, and driven on the construction site to carry out the concrete pouring operation. Slurry and sludge pumps are normally stationary and in most instances, they are used in sludge plants.

These types of pumps include a pump body with a plurality of cylinder bores receiving therein reciprocating pistons which are hydraulically actuated. An oscillating valve conduit moves across the deck surface of the pump body between two operative positions, in which the inlet port of the valve conduit is in register with a respective cylinder whose piston is on the discharge stroke.

The fluids usually pumped by this type of equipment are very abrasive and cause extensive wear between the deck surface of the pump body and the valve conduit which is in sliding contact therewith. As a result, sealing problems arise between the pump body and the valve conduit which may considerably degrade the performance of the pump. In order to prevent or at least reduce leakage between these two components of the pump, it has been suggested by the past to provide a tensioning mechanism which urges in sealing engagement the valve conduit against the pump body. Such tensioning systems are mechanically simple however, they require periodic adjustments to compensate for wear of the deck surface. In addition, these adjustments, normally to be performed immediately before the pump start-up procedure, are delicate and require qualified and experienced personnel.

OBJECTS AND STATEMENTS OF THE INVENTION

The principal object of the invention is a pump for a heavy flowable material such as sludge, slurry, concrete or the like, with improved sealing characteristics between the pump body and the oscillating valve conduit.

A further object of the invention is a pump for slurry, sludge, concrete or the like, with a system to urge the valve conduit in sealing engagement with the pump body, which requires little or no periodic adjustment.

In one aspect, the invention provides a pump for heavy flowable materials, comprising a pump body, a valve conduit mounted for pivotal movement about an axis, the valve conduit including a port for transferring flowable material between the cylinder bores of the pump body and the valve conduit. The port moves across the deck surface of the pump body between two operative positions as a result of the pivotal movement of the valve conduit. In each operative position, the port is in register with a respective cylinder bore. The improvement resides in providing a fluid actuated piston-cylinder assembly which exerts a force with a direction generally coincident with the pivotal axis of the valve conduit in order to urge the valve conduit toward the pump body causing a sealing engagement between the port of the valve conduit and the deck surface of the pump body.

In a preferred embodiment, the valve conduit is S-shaped and it is mounted to an elongated cylindrical drive shaft coupled to a driving mechanism which imparts an oscillatory motion to the valve conduit. A hydraulic piston-cylinder assembly urging the valve conduit against the pump body is mounted on the elongated drive shaft in order to exert a pulling force along the pivotal axis of the valve conduit. This arrangement is advantageous because it allows to obtain a good sealing engagement between the valve conduit and the pump body, and requires little or no periodic adjustments in spite of wear between these components. In addition, the pulling force exerted by the hydraulic piston-cylinder may be easily controlled simply by varying the pressure of the operating fluid supplied thereto.

In summary, the present invention comprises a pump for heavy flowable materials comprising:

a pump body with a deck surface;

a pair of cylinder bores opening at the deck surface;

a piston reciprocating in each cylinder bore in charging and discharging strokes;

a movable valve conduit comprising a port for transferring flowable material between the cylinder bores and the valve conduit, the valve conduit being pivotable about an axis to cause a movement of the valve conduit port across the deck surface between two operative positions, in each operative position the port is in register with either one of the cylinder bores; and a fluid operated piston-cylinder assembly operatively mounted between the valve conduit and the pump body producing a force with a direction generally coincident with the pivotal axis of the valve conduit urging the valve conduit port in sealing engagement with the deck surface.

The invention also extends to a sludge pump, comprising:

a pump body with a deck surface;

a pair of cylinder bores in the pump body opening at the deck surface;

a piston reciprocating in each cylinder bore in charging and discharging strokes;

a movable valve conduit comprising a port for transferring sludge between the valve conduit and the cylinder bores, the valve conduit being pivotable about an axis causing a movement of the valve conduit port across the deck surface between two operative positions, in each operative position the valve conduit port is in register with a respective cylinder bore;

an elongated shaft extending along the pivotal axis of the valve conduit, the elongated rod being mounted to the valve conduit;

means rotating the elongated rod for producing the pivotal movement of the valve conduit; and a fluid operated piston-cylinder assembly acting on the elongated rod for producing a force thereon with a direction generally coicident with the pivotal axis of the valve conduit urging the valve conduit in sealing engagement with the pump body.

DESCRIPTION OF A PREFERRED EMBODIMENT

Figure 1:
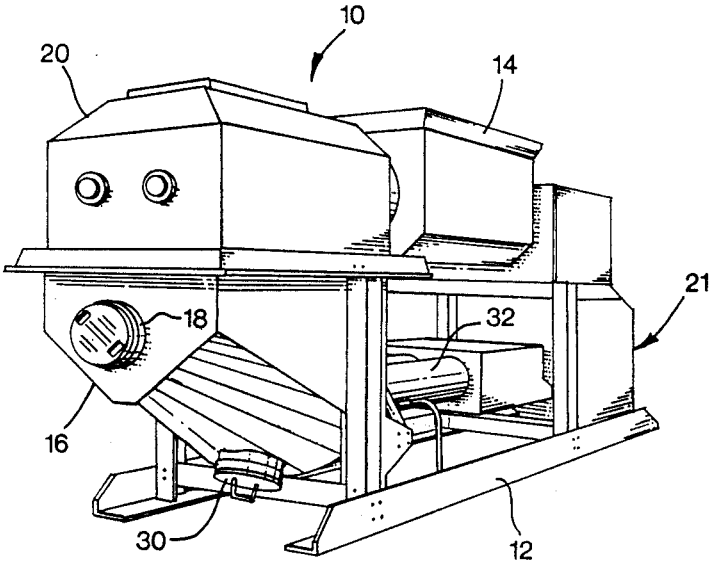
FIG. 1 is a perspective view of a sludge pump constructed in accordance with the invention.
Figure 2:
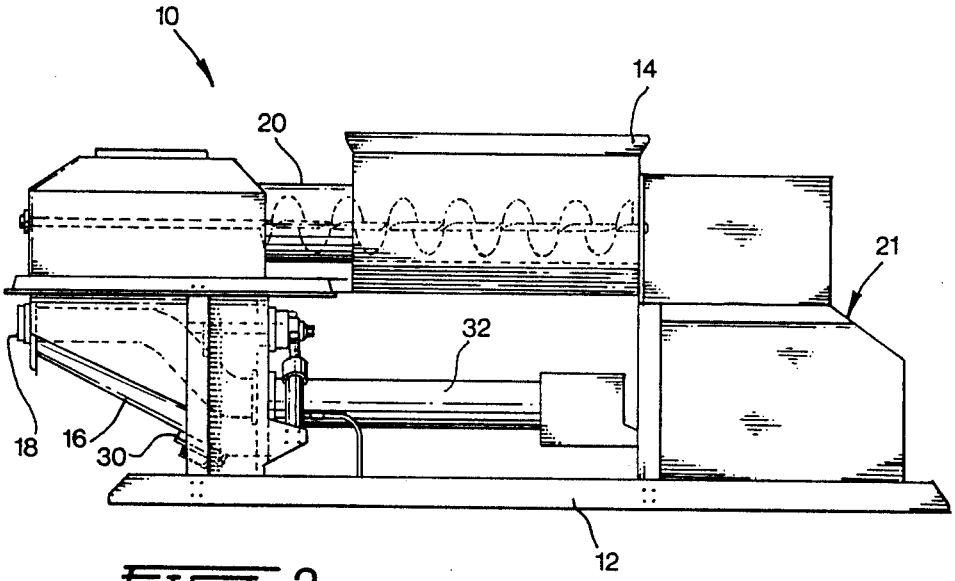
FIG. 2 is a side elevational view of the sludge pump illustrated in FIG. 1.
Figure 4:
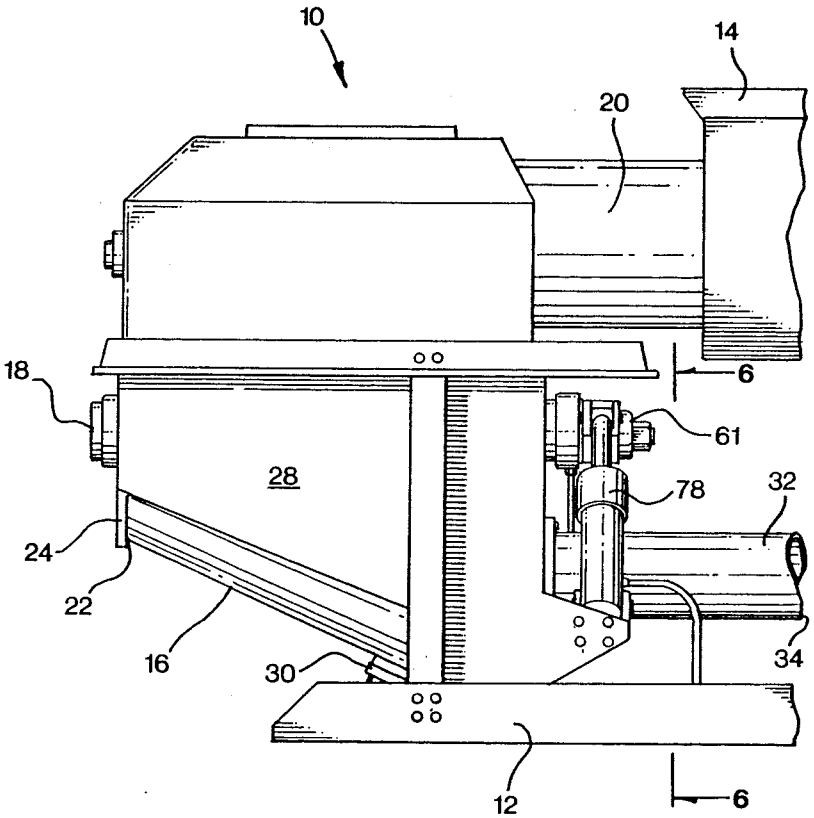
FIG. 4 is an enlarged partial side elevational view of the sludge pump shown in FIG. 1.
Figure 3:
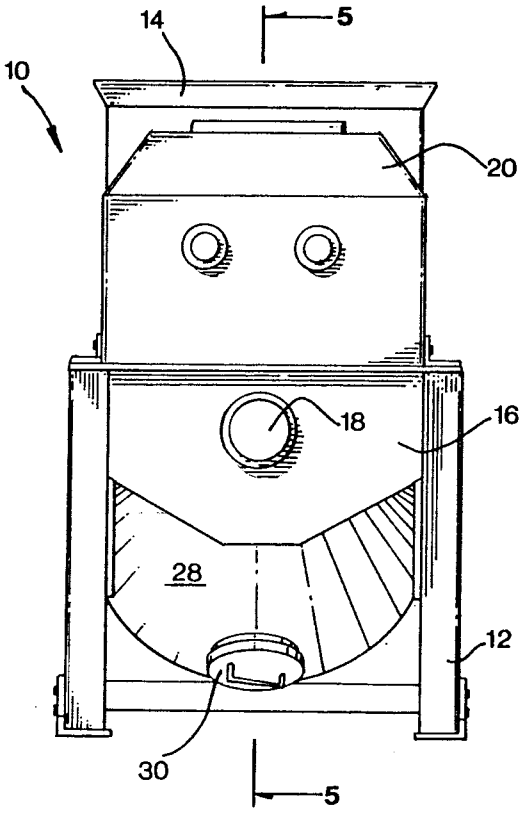
FIG. 3 is a front view of the sludge pump shown in FIG. 1.
Figure 5:
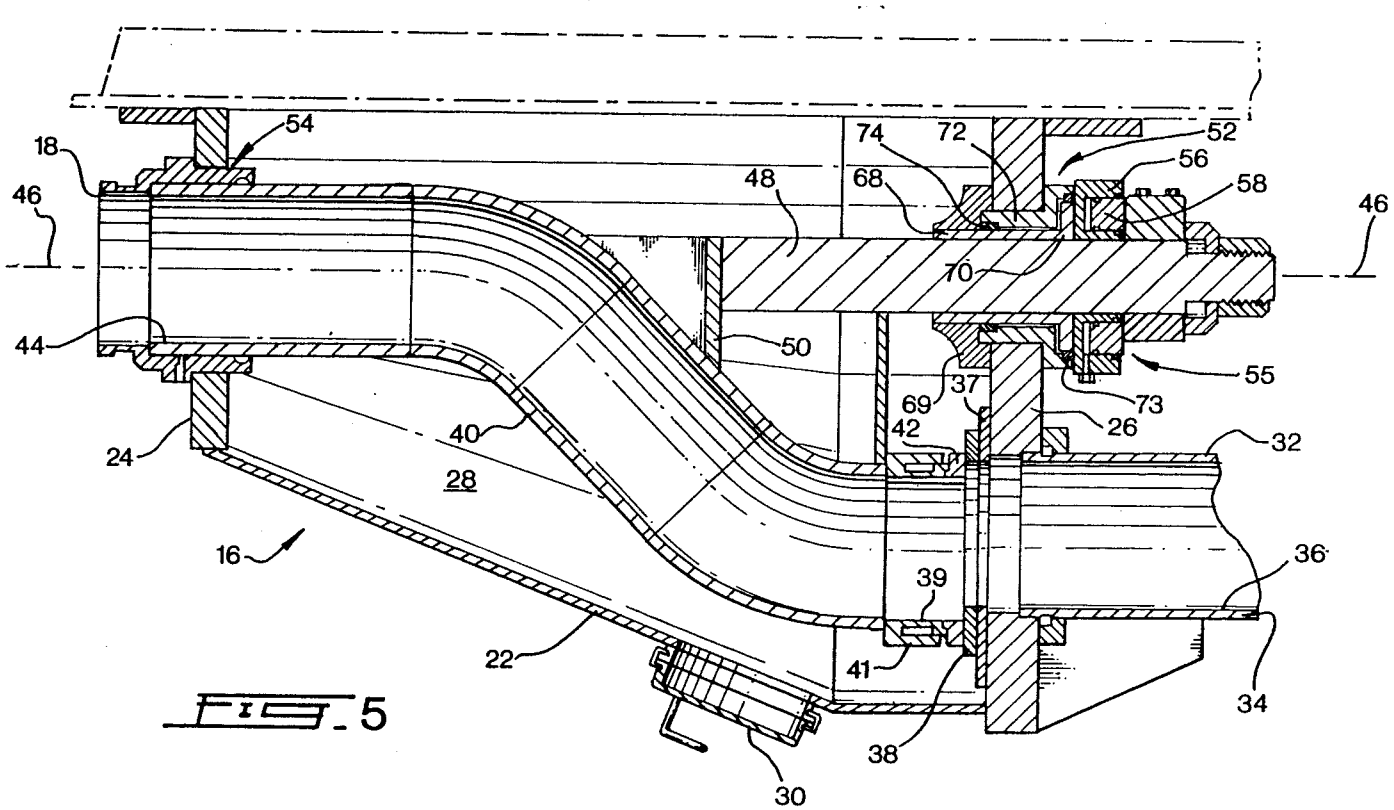
FIG. 5 is a sectional view taken along lines 5—5 in FIG. 3.
Figure 6:
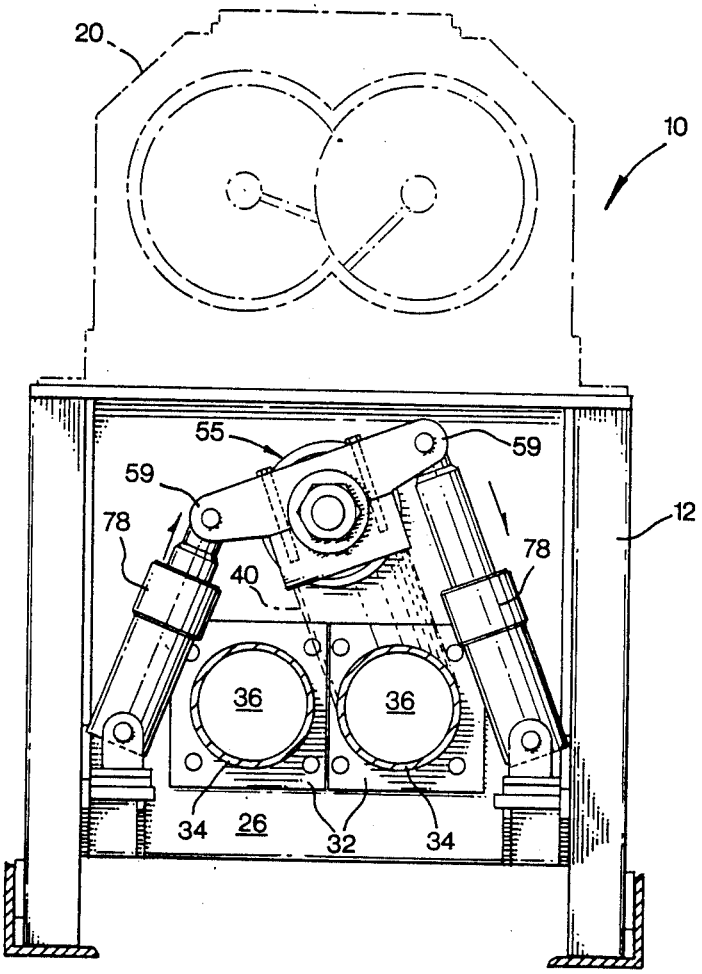
FIG. 6 is a sectional view taken along lines 6—6 in FIG. 4.

FIGS. 1, 2 and 3 illustrate a stationary multi-cylinder sludge pump which is identified by the reference numeral 10. The pump 10 comprises a frame 12 made of metallic members bolted to each other in order to form a rigid assembly supporting a hopper 14 for receiving sludge to be pumped, a pumping assembly 16 having an outlet 18, and a conveyor assembly 20 for transferring sludge from the hopper 14 to the pumping assembly 16. The conveyor 20 is of the double auger type, known to those skilled in the art. A detailed description of this component will not be provided because it is not an essential element of the invention and also its design and fabrication are within the reach of a skilled artisan.

The frame 12 also carries the various hydraulic controls, pumps and lines, identified generally by the numeral 21, to operate the components of the sludge pump 10, however, these will not be described in detail because they are of conventional construction.

Referring now to FIGS. 4 to 10, the pumping assembly 16 comprises a metallic casing 22 located immediately below the outlet of the conveyor 20, comprising a front wall 24, a rear wall 26 and a curved lateral wall 28. On the bottom of the lateral wall 28 is provided an inspection hatch 30.

The pumping assembly 16 further includes a multi-cylinder pump block or body 32 secured to the rear wall 26 of the casing 22, comprising two generally parallel cylinders 34 defining respective cylinder bores 36. The pump body 32 is a multi-component assembly, however, it may be envisaged to make it integrally such as by casting. A support plate 37 is bolted to the rear wall 26 and carries a deck plate 38. The deck plate 38 is secured to the support plate 37 by welding. The plates 37 and 38 comprise openings which register with the respective cylinder bores 36 within the respective cylinder bores 36 are mounted reciprocating pistons (not shown in the drawings) moving in successive charging and discharging strokes as it well known to those skilled in the art. The pistons driving mechanism is not illustrated in the drawings nor described herein because it is of a conventional construction.

An oscillating valve conduit 40 is mounted in the casing 22 and extends between the deck plate 38 and the outlet 18 of the sludge pump 10. The valve conduit 40 is made of metallic material and comprises a flanged inlet port 42 which slidingly and sealingly engages the deck plate 38, including a cylindrical body 39 received in a mating expanded end-portion 41 of the valve conduit 40. The latter further includes an outlet port 44 which defines the outlet 18 of the pump 10. The sliding connection between the inlet port 42 and the deck plate 38 is free of any elastomeric seal or other type of gasket.

The valve conduit 40 undergoes an oscillatory motion by pivoting about an axis identified by the reference numeral 46 in order to move the inlet port 42 across the deck plate 38 between two operative positions. In each operative position, the inlet port 42 is aligned with a respective cylinder bore and remains in register therewith during the discharge stroke of the piston in that cylinder bore. In order to achieve this pivotal motion, the valve conduit 40 is provided with a cylindrical drive shaft 48 with an end connected to the valve conduit by means of braces 50, the opposite end of the drive shaft extending through the rear wall 26 of the casing 22 and being coupled to a drive mechanism to be described later. A bearing 52, which will be described in detail hereinafter, is provided to support the drive shaft 48 in the wall 26.

The outlet end of the valve conduit 40 is pivotally mounted in the front wall 24 of the casing 22 by means of a suitable bearing 54 which allows the pivotal motion of the valve conduit 40 as well as slight axial movement thereof. It will be appreciated that the pivotal axis 46 of the valve conduit 40 is common to the centerlines of the bearings 52 and 54 and also coincides with the longitudinal axis of the drive shaft 48.

Figure 8:
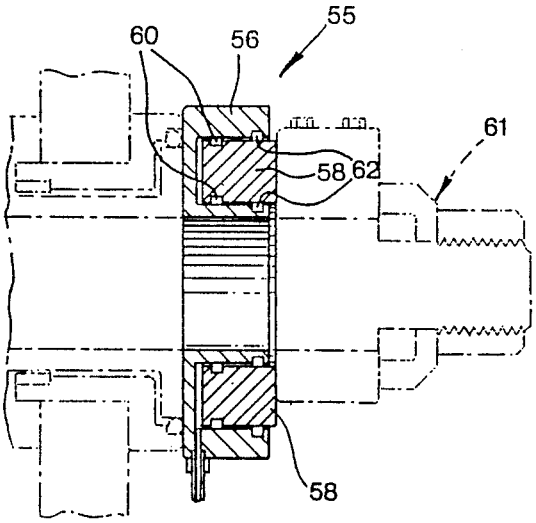
FIG. 8 is a sectional view taken along lines 8—8 in FIG. 7.
Figure 9:
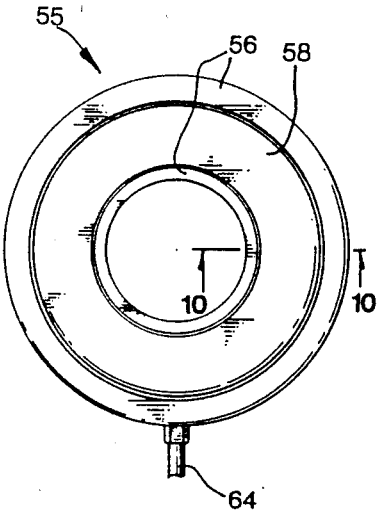
FIG. 9 is an elevational view of the hydraulic piston-cylinder assembly for producing a sealing engagement between the valVe conduit and the pump body of the sludge pump according to the invention.
Figure 10:
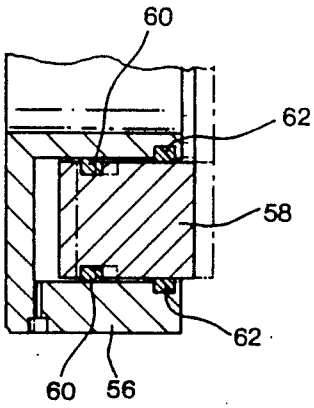
FIG. 10 is a sectional view taken along lines 10—10 in FIG. 9.
Figure 7:
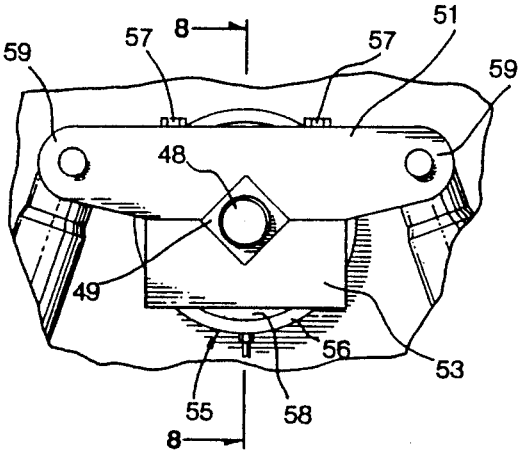
FIG. 7 is an enlarged partial view of a connection system used for mounting an oscillating mechanism to the valve conduit of the sludge pump according to the invention.

The drive shaft 48 carries a hydraulic shaft puller assembly 55 for urging the valve conduit 40 against the pump body 32 to create a sealing engagement between the deck plate 38 and the inlet port 42. The hydraulic shaft puller assembly includes an annular cylinder 56 slidingly mounted on the drive shaft 48, receiving an annular piston 58 therein. The structure of the hydraulic shaft puller assembly 55 is best illustrated in FIGS. 8, 9 and 10. The annular cylinder 56 and the piston 58 are made of metallic material and are provided with seals to prevent leakage of operating fluid therebetween. More particularly, the piston 58 is provided with two U-seals 60 which engage the opposite concentric walls of the cylinder 56, and the cylinder itself is provided with two dust U-seals 62 engaging the piston 58. Operating fluid is supplied to the annular cylinder 56 through a line 64 from the hydraulic circuit of the sludge pump 10.

The shaft 48 is provided with a portion 49 having a square cross-sectional shape on which are mounted two mating plates 51 and 53 secured to each other by means of bolts 57. The plate 51 is provided with laterally extending projections 59. The plates 51 and 53 define a rectangular opening receiving the square portion 49, whereby no rotation is possible therebetween. The plates 51 and 53 are locked against axial displacement on the shaft 48 by a nut and washer assembly 61, maintaining the plates 51 and 53 against the annular piston 58.

Referring back to FIG. 5, the bearing 52 supporting the shaft 48 to the rear wall 46 comprises an inner sleeve 68 slidingly mounted on the shaft 48 and being provided with a flanged end 70 in abutting relationship with the annular cylinder 56 and keyed thereto for preventing a rotational movement therebetween. An outer sleeve 72, secured to the wall 26 rotatably receives the inner sleeve 70. A collar 69 is secured on the inner sleeve 68 and projects radially beyond the outer sleeve 72. The combination between the flange 70 and the collar 69 locks axially the sleeves 68 and 72 limiting the motion of the inner sleeve 68 within the outer sleeve 72 to rotation only. To prevent leakage of sludge through the bearing 52, a U-seal 74 is provided between the sleeves 68 and 72. To prevent dirt or other contaminants from entering the bearing 52 from the exterior, an annular elastomeric wiper 73 is provided between the sleeves 68 and 72, spaced from the seal 74.

The drive system for imparting an oscillatory motion to the valve conduit 40 is of a type well known in the art. Suffice it to say that it comprises two hydraulic piston-cylinder assemblies 78, best shown in FIGS. 4, 6 and 7 having their cylinders pivotally connected to the frame 12 and their piston rods pivotally mounted to the projections 59 which are radially offset from the centerline 46 of the drive shaft 48. By extending one of the cylinders, and consequently retracting the other one, a limited angular displacement of the shaft 48 about the axis 46 will be produced.

The operation of the sludge pump 10 is as follows. The casing 22 of the pumping assembly 16 is normally kept full with sludge to be pumped which is delivered by the double auger type conveyor 20 fed through the hopper 14. Hydraulic fluid under pressure is supplied to the actuating cylinders 78 in timed relation in order to produce the oscillating movement of the valve conduit 40 about the pivoting axis 46. The oscillating movement of the valve conduit 40 will produce a translational movement of the flanged inlet port 42 across the deck plate 38 between two operative positions. When the valve conduit 40 is in one of the operative positions as shown in dashed lines in FIG. 6, the inlet port 42 is aligned with the right hand cylinder bore 36 whose piston undergoes a discharge stroke, in other words, pushing sludge in the valve conduit 40. At the same time, the piston in the other cylinder bore 36 is on a charge stroke drawing sludge therein. At the completion of the discharge stroke, the hydraulic piston-cylinder assemblies 78 are actuated in order to switch the valve conduit to the other operative position (not shown in the drawings) in which the inlet port 42 is in register with the left hand cylinder bore 36, for receiVing another charge of sludge. This cycle is repeated continuously during the operation of the pump 10.

To press the inlet port 42 against the deck surface 38 in order to create a sealing engagement between these components, the hydraulic shaft-pulling assembly 55 is actuated by pumping between the annular cylinder 56 and the annular piston 58 hydraulic fluid. The operating fluid under pressure, forces the piston 58 out of the cylinder 56 which is held axially captive against the flange 70 of the inner bearing sleeve 68. As a result, the piston 56 pressing on the plates 51 and 53 causes a pulling force on the drive shaft 48 directed along the axis 46. This pulling force will press firmly the flanged inlet port 42 against the deck plate 38 in sealing engagement therewith so as to prevent or at least minimize leakage of high pressure sludge therebetween. It will be appreciated that as a result of wear between these two components, the valve conduit 40 will gradually move toward the pump body 32 which movement will be compensated by a further extension of the piston 58 from the cylinder 56 in order to maintain the amount of pressure of the inlet port 42 against the deck surface 38 identical. This axial movement of the valve conduit 40 is allowed at the bearing 54, and at the bearing 52 by virtue of the sliding fit between the drive shaft 48 and the inner sleeve 68, and also the sliding engagement of the annular piston 56 on the drive shaft 48. It will be appreciated that during the sliding movement of the drive shaft 48 in the bearing 52, no sliding movement, i.e. translational motion, is allowed between the sleeves 68 and 72 because they are axially locked together. When extensive wear occurs at the deck plate 38 and the inlet port 42, these components may be replaced by new ones.

The pressure of the inlet port 42 against the deck plate 38 is function of the pressure of operating fluid supplied to the hydraulic shaft-pulling assembly 55. By maintaining the operating fluid pressure constant during the operation of the pump, the sealing characteristics of the sliding joint between the valve conduit 40 and the pump body 32 are not expected to change much even after a considerable amount of wear at the deck plate 38 and at the inlet port 42. Complex pressure schemes between these components can also be achieved by modulating the operating fluid pressure in the appropriate manner.

The above description of a preferred embodiment of this invention should not be interpreted in any limiting manner since the embodiment may be refined and varied in several ways without departing from the spirit of the invention. For example, the invention may be applied to pumps for heavy flowable materials with a valve conduit referred to as "rock valve" of the type described in Canadian patent No. 1,156,089 issued to Schwing (Friedrich Wihl.) G.m.b.H. Other refinements are also possible. The scope of the invention is defined in the annexed claims.

We claim:

1. A pump for heavy flowable materials, comprising:
- a pump body with a deck surface;
- a pair of cylinder bores opening at said deck surface;
- a piston reciprocating in each cylinder bore in charging and discharging strokes;
- a valve conduit comprising a port for transferring flowable material between said valve conduit and said cylinder bores, said valve conduit being pivotable about an axis to cause a translational movement of said port across said deck surface between two operative positions, in each opeative position said port is in register with either one of said cylinder bores; and
- a fluid operated piston-cylinder assembly operatively mounted between said valve conduit and said pump body producing a force with a direction generally coicident with said axis for urging said port in sealing engagement with said deck surface.

2. A pump as defined in claim 1, wherein said fluid operated piston-cylinder assembly comprises a cylinder and a piston received therein movable one relative to the other along said axis.

3. A pump as defined in claim 1, further comprising a casing for receiving flowable material to be pumped, said casing receiving said valve conduit.

4. A pump as defined in claim 3, wherein said fluid-operated piston-cylinder assembly is mounted outside of said casing, said pump further comprising a link coupling said fluid-operated piston-cylinder assembly to said valve conduit.

5. A pump as defined in claim 4, further comprising a bearing means between said link and said casing allowing a rotational and a sliding moVement of said link relatively to said casing.

6. A pump as defined in claim 5, wherein said link is a generally cylindrical rod.

7. A pump as defined in claim 6, comprising an annular body defining a cavity slidingly mounted on said cylindrical rod and in abutment on said bearing means, and an annular piston acting on said rod and being slidingly mounted in said annular body.

8. A pump as defined in claim 7, further comprising means acting on said cylindrical rod for pivoting said valve conduit about said axis.

9. A sludge pump, comprising:

a casing for receiving sludge;

a pump body with a deck surface, said deck surface extending in said casing;

a pair of cylinder bores in said pump body opening at said deck surface;

a piston reciprocating in each cylinder bore in charging and discharging strokes;

a valve conduit comprising a port for transferring sludge between said valve conduit and said cylinder bores, said valve conduit being pivotable about an axis to cause a translational movement of said port across said deck surface between two operative positions, in each operative position said port is in register with a respective cylinder bore;

a drive shaft extending along said axis and being mounted to said valve conduit;

means rotating said drive shaft for producing the movement of said port across said deck surface; and a fluid operated piston-cylinder assembly acting on said drive shaft for producing a force thereon with a direction generally coicident with said axis for urging said valve conduit toward said pump body for creating a sealing engagement between said port and said deck surface.

10. A sludge pump as defined in claim 9, wherein said fluid operated piston-cylinder assembly is operatively mounted between said drive shaft and said casing.

11. A sludge pump as defined in claim 9, comprising an annular body defining a cavity mounted on said drive shaft, and a piston mounted in said cavity.

12. A sludge pump as defined in claim 11, wherein said annular body is slidingly mounted on said drive shaft.

13. A sludge pump as defined in claim 12, further comprising stop means on said drive shaft, the piston mounted in said annular body being in abutment on said stop means.

14. A pump as defined in claims 1 or 9, wherein said fluid operated piston-cylinder assembly is a hydraulic piston-cylinder assembly.

* * * * *